US005530430A

United States Patent [19]

Pavlov

[11] Patent Number: 5,530,430

[45] Date of Patent: Jun. 25, 1996

[54] VIBRATION RESPONSIVE BARBED TAPE SECURITY SYSTEM

[76] Inventor: Michael Pavlov, R.D. 4, Box 27A, Kingston, N.Y. 12401

[21] Appl. No.: 280,309

[22] Filed: Jul. 26, 1994

[51] Int. Cl.[6] ..... G08B 13/00

[52] U.S. Cl. ..... 340/566; 340/550; 340/541; 256/2; 256/8; 256/32

[58] Field of Search ..... 340/566, 550, 340/541, 557, 600; 256/8, 32, 2

[56] References Cited

U.S. PATENT DOCUMENTS 4,503,423 3/1985 Mainiero ..... 340/552
4,680,573 7/1987 Ciordinik ..... 340/541
4,818,972 4/1989 Mainiero et al. .
4,906,975 3/1990 Casella et al. .
5,194,847 3/1993 Taylor et al. .

*Primary Examiner*—Brent A. Swarthout
*Assistant Examiner*—Albert K. Wong
*Attorney, Agent, or Firm*—Schmeiser, Olsen & Watts

[57] ABSTRACT

The invention is a barbed tape barrier that includes a tube that acts as a support for the loops of barbed tape. Located within the tube is a fiber optic cable that is vibration sensitive and connected to a control unit. If an intruder disturbs the barrier, the resultant vibrations will be detected by the control unit and an alarm will be actuated.

20 Claims, 1 Drawing Sheet

VIBRATION RESPONSIVE BARBED TAPE SECURITY SYSTEM

FIELD OF THE INVENTION

The invention is in the field of security barriers. More particularly, the invention is a security barrier that employs a spiral of barbed tape with an attached reinforcing member in the form of a straight tube. Located within the tube is a vibration-sensitive fiber optic cable that is connected to a control unit and acts like a microphone. The control unit sends light through the fiber optic cable and monitors the received light for changes in the cable's light transmission characteristics caused by vibration of the barbed tape and attached tube. If changes are detected, the control unit will cause an alarm to be actuated.

BACKGROUND OF THE INVENTION

Helically-configured barbed tape (the modern version of barbed wire) is often used about the perimeter of a secured area to prevent unauthorized entry into the area. The tape is in the form of a thin metal strip having a plurality of outwardly-extending barbs. In most applications, the tape is placed on a fence, wall or roof to enhance the impassibility of the existing barrier. In other applications, helicoidal barbed tape is used independently as a barrier.

There are two major weaknesses of barbed tape barriers that can be exploited by an individual who wishes to get past such a barrier. Firstly, the helical configuration of a barbed tape barrier is not extremely rigid and the loops of tape may be bent, flattened or spread apart using a wide board or similar object. Secondly, unless an alarm of some sort is combined with the barbed tape, a person may go undetected while employing a tool such as a bolt cutter or saw to cut through the tape and thereby remove it as an obstacle.

Many improvements have been made to barbed tape barriers to mitigate the above-noted weaknesses. The tape itself has been modified to include a center-located strengthening groove to improve its resistance to bending. In addition, there have been some attempts to add an alarm system to the barbed tape. In one example of such a system (Mainiero et al, U.S. Pat. No. 4,818,972), a vibration sensitive wire is incorporated within the tape and connected to a remote alarm unit.

Even with the above improvements, modern barbed tape barriers still suffer to some degree from many of the same problems as their simpler predecessors. The loops of the tape can still be flattened, bent or spread apart by an individual using a suitable tool. The alarm systems that are presently used in combination with barbed tape barriers are extremely expensive and their sensitivity is quite variable.

SUMMARY OF THE INVENTION

The invention is a security barrier that combines a helically-configured barbed tape with a straight tube that contains a portion of a vibration detection system employing optical fiber technology. The barrier is preferably anchored to a support structure such as a wall, fence or roof. Alternatively, the barrier can be deployed as a stand-alone unit.

The barbed tape is in the form of a long metal strip that is configured in a helically-distributed loop pattern. A plurality of sharp barbs extend outwardly from each side edge of the strip.

The tube is preferably made of metal or plastic and extends in a straight direction. It should be noted that the word "tube" is used to refer to the broad category of structures such as pipes, conduits, and channels that have an open interior area at least partially surrounded by a wall. In the preferred embodiment, an aluminum or stainless steel non-corrosive BX or other type of flexible metal conduit is used for the tube. A flexible metal conduit is formed from a metal spiral and is semi-flexible. The tube can also be manufactured from rigid or flexible materials. Each loop of the tape is directly secured to and in contact with the tube. In the preferred embodiment, a metal clip or the like is used to attach each loop of tape to the tube. In this manner, a vibration in any loop of the tape is directly transmitted to the tube. The tube helps to support and strengthen the barbed tape since the tube is preferably virtually incompressible and thereby maintains the spacing of the loops via the attachment clips.

The vibration-detecting portion of the barrier makes use of a fiber optic cable located within the tube preferably in a non-constrained manner. The interior bore of the tube is preferably larger than the diameter of the cable thereby enabling the cable a degree of movement within the tube. Any vibration of the tube will cause the cable to vibrate or shift, and as a result, the light transmission characteristic of the cable will temporarily change. In effect, the cable within the tube functions like an extremely sensitive microphone.

It should be noted that the tube also protects the cable from contact with the elements, contact with the barbs of the tape and makes the cable inaccessible to an intruder. In an alternate embodiment of the invention, the tube is a tight fit on the cable.

The fiber optic cable is connected to a control unit that includes a light transmitter, a light receiver, an analyzer that analyzes the received light for vibration produced changes, and an alarm unit. The alarm unit is actuated by the analyzer when the light signal passing through the fiber optic cable is significantly changed by vibrations caused by a person contacting either the tube, the barbed tape or the supporting structure (if used). In this manner, the tube, barbed tape and fence act as a microphone/sensor for the alarm system to provide a signal that can be amplified to obtain an audio output or used as the primary signal for the alarm system.

Therefore, the invention is a barbed tape barrier that has superior strength compared to prior art barbed tape barriers due to the direct attachment of the loops of barbed tape to the tube. The dual functionality of the tube, with its being part of an alarm system, further significantly enhances the invention compared to the prior art. Since the tube functions to transmit and in some instances magnify vibration, the combined components of the barrier provide the alarm system with a superior degree of sensitivity.

DETAILED DESCRIPTION OF THE DRAWINGS

Figure 2:
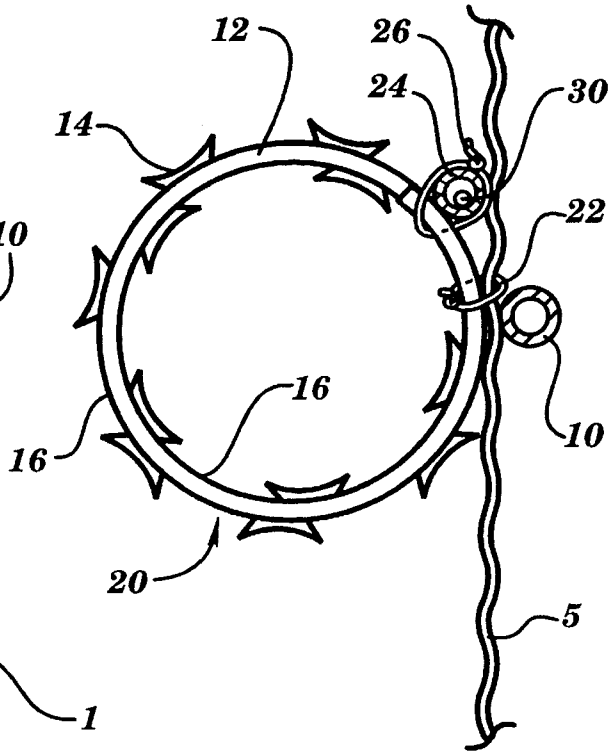
FIG. 2 is a side view of the fence and barrier shown in FIG. 1 taken along plane 2—2.

Referring now to the drawings in greater detail, wherein like reference characters refer to like parts throughout the several figures, there is shown by the numeral 1 a portion of a fence-type barrier used to surround an area. The barrier includes a chain-link fence 2 and a secondary barrier 4 in the form of a spiral of barbed-tape modified in accordance with the invention.

The chain-link fence 2 is composed of chain-link fencing material 5 attached to vertical uprights 6 that are secured to the ground 8. Horizontal members 10 extend between the uprights and provide added support for the chain-link fencing material. The uprights 6 and horizontal members 10 are preferably in the form of lengths of metal tubing.

The barbed-tape 4 is formed from a helically-disposed length of conventional barbed tape 12 (note FIG. 2) manufactured from a continuous strip of metal material. The metal strip is thin and has a plurality of sharp barbs 14 spaced along its length and that extend outwardly from opposite side edges 16 of the strip. The spiral/helical configuration of the barbed tape comprises a plurality of seemingly circular loops 20 that lie perpendicular to the plane of the fencing. Each of the loops is secured to the fence 1 using a metal clip 22 or other type of conventional fastening member. It should be noted that the loops 20 are secured to the fence at spaced points, thereby creating a first mechanism for fixing the spacing between the loops.

Figure 1:
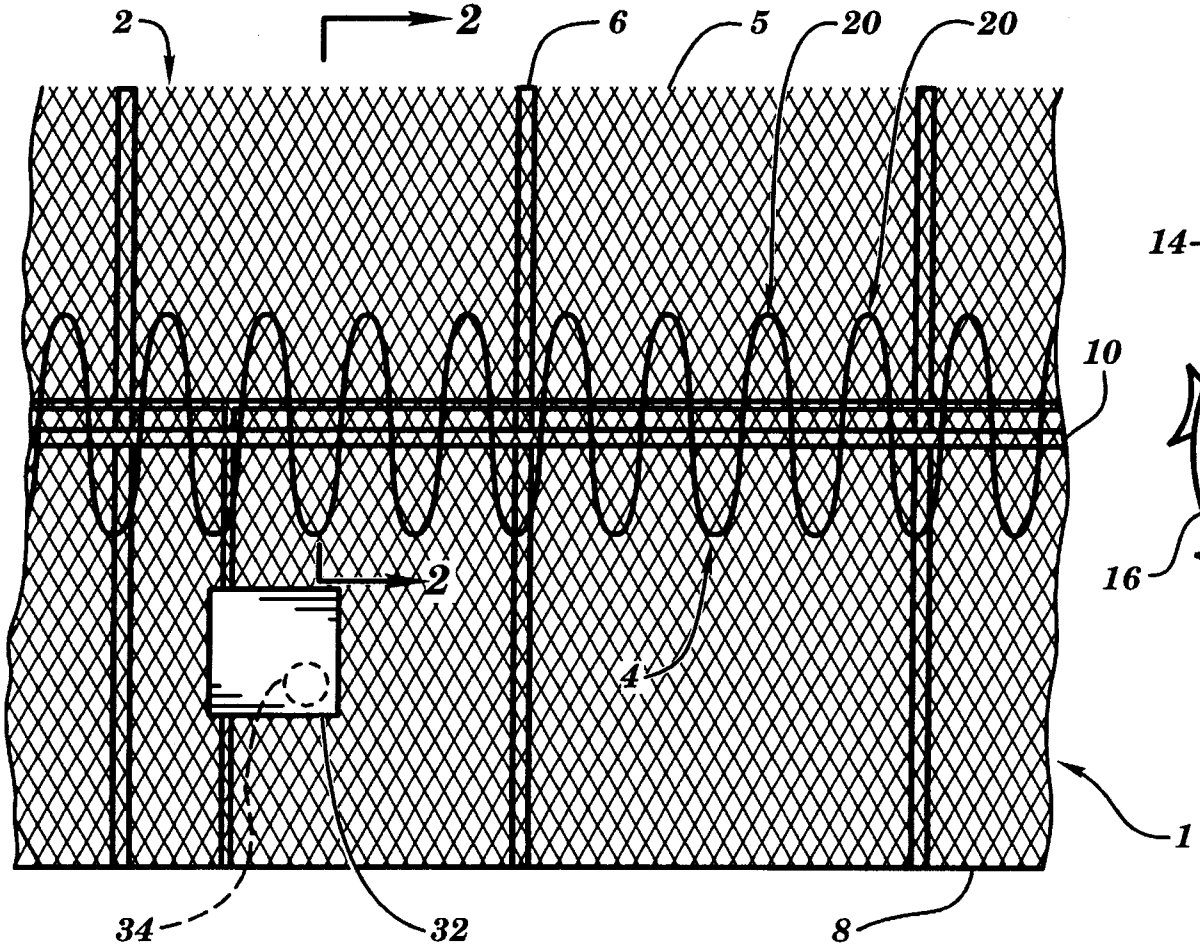
FIG. 1 is a front view of a portion of a fence that includes a barbed tape barrier in accordance with the invention.

As shown in the figures, a tube 24 is in direct contact with each loop of the barbed tape. A clip 26 or similar conventional fastening member (such as a wire tie) is used to attach each loop of the tape to the tube in a fixed manner. This provides a second mechanism for fixing the spacing between loops of the barbed tape and increases the strength and rigidity of the tape. It should be noted that due to the spiral configuration of the barbed tape barrier, clip 22 will be spaced both horizontally and vertically from clip 26 (note FIGS. 1 and 2). This provides two spaced supports for the loops 20. The use of two separate support mechanisms for the loops of tape and having each loop directly attached to the tube makes it more difficult for an intruder to spread apart any two adjacent loops of the tape.

Located within the tube in a non-constrained manner is a vibration sensitive fiber optic cable 30. The cable is designed to transmit light pulses in a predictable manner. Due to the cable's placement within the tube, the tube's direct attachment to the barbed tape and the tape's direct attachment to the fencing material, any movement or vibration of the tube, barbed tape or the fence will cause a vibration of the fiber optic cable. When the cable is vibrated or moves within the tube, its light transmission characteristics will be temporarily altered. It should be noted that as an alternative embodiment, the tube can be a tight fit on the cable. However, this will reduce the system's ability to sense contact with the barrier based on a shifting of the cable within the tube.

Located proximate the fence is a control unit 32. This unit is operatively connected to the fiber optic cable and includes a light transmitter (not shown) for sending a light signal through the cable. The unit also includes a light receiver (not shown) that receives the light signal that has passed through the cable, an analyzer (not shown) that analyzes the received light, and an alarm unit 34. The alarm unit is actuated by the analyzer when the analyzer detects that the light signal passing through the fiber optic cable has been significantly changed due to vibrations or movements of the cable caused by a person contacting either the tube, the barbed tape or the supporting structure (if used). It should be noted that this type of control unit is known in the alarm art for use with fiber optic cables.

While the alarm unit 34 is shown at a location proximate the fence, it should be noted that the alarm unit can instead be placed at a remote location. As another alternative, the analyzer could cause lights to be energized, a gate to be opened or some other action in lieu of actuating an alarm. It should also be noted that, as conventional for this type of control unit, the unit will include user-adjustable filters (not shown) that can alter the threshold at which the alarm unit will be actuated.

Therefore, by providing a barbed tape barrier with a secondary support (tube 24) that is directly linked with an alarm system, the barrier is both strengthened and provided with an alarm capability. By placing the tube in contact with the barbed tape, its ability to directly transmit vibrations to the fiber optic cable provides the alarm system with a level of sensitivity to vibration not found in the prior art. The use of a flexible or semi-flexible material for tube 24 facilitates movement of the tape and thereby further increases the vibration sensitivety of the alarm system.

It should be noted that as another alternate embodiment of the invention, the tube 24 can be attached to both the fence and the barbed tape. One method of accomplishing this is by locating the tube so that it passes through clips 22.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A barrier comprising:

a length of barbed tape in the form of a plurality of interconnected loops in a helical configuration, said tape being composed of an elongated, thin metal strip having a plurality of outwardly-extending barbs spacedly located along opposite side edges of said strip;

a substantially straight tube adjacent to the barbed tape;

an attachment means located at each loop of barbed tape and functioning to attach each of said loops to said tube whereby each of said loops will be spaced from each other;

a fiber optic cable located within said tube, said cable having light transmission characteristics that change when said cable is subjected to a predetermined level of vibrations;

a control unit operatively connected to said fiber optic cable, said control unit having a light transmitting means capable of sending light through said cable, a light receiving means capable of receiving light that has passed through said cable, an analyzer for analyzing the received light, and an alarm means capable of issuing an alarm signal;

wherein the analyzer can cause the actuation of the alarm means when the cable has been subjected to a predetermined level of vibrations; and wherein a plurality of the loops of barbed tape are oriented so that they are substantially perpendicular to the tube.

2. The barrier of claim 1 wherein the fiber optic cable is loosely retained within the tube.

3. The barrier of claim 1 wherein the tube is manufactured from a flexible material.

4. The barrier of claim 1 wherein the tube is manufactured from a semi-rigid material.

5. The barrier of claim 1 wherein the tube is manufactured from a rigid material.

6. The barrier of claim 1 wherein the tube is a flexible BX-type metal conduit.

7. The barrier of claim 1 wherein the tube is in direct contact with each loop of the barbed tape.

8. The barrier of claim 1 wherein a plurality of the loops of barbed tape are oriented so that an imaginary straight line joining a center point of each loop would extend substantially parallel to the tube.

9. A barrier system comprising:

a length of barbed tape in the form of a plurality of interconnected loops, said tape being composed of an elongated, thin metal strip having a plurality of outwardly-extending barbs spacedly located along opposite side edges of said strip;

a substantially straight tube;

an attachment means located at each loop of barbed tape and functioning to attach each of said loops to said tube whereby each of said loops will be spaced from each other;

a fiber optic cable located within said tube, said cable having light transmission characteristics that change when said cable is subjected to a predetermined level of vibrations and wherein said tube has an inner diameter that is greater than an outer diameter of the fiber optic cable whereby said cable can move about within said tube in response to predetermined levels of movement of said tube;

a control unit operatively connected to said fiber optic cable, said control unit having a light transmitting means capable of sending light through said cable, a light receiving means capable of receiving light that has passed through said cable, an analyzer for analyzing the received light, and an alarm means capable of issuing an alarm signal and wherein the analyzer can cause the actuation of the alarm means when the cable has been subjected to a predetermined level of vibrations; and a support means to which the barbed tape is secured.

10. The system of claim 9 wherein a plurality of the loops of barbed tape are oriented so that an imaginary straight line joining a center point of each loop would extend parallel to the tube.

11. The system of claim 9 wherein the support means is a vertically-oriented planar barrier.

12. The system of claim 11 wherein the barbed tape is rigidly secured to said planar barrier and the tube is rigidly secured to said barbed tape and spaced apart from said planar barrier.

13. The system of claim 11 wherein the planar barrier is in the form of a fence having a planar sheet of interconnected metal wires attached to and supported by a plurality of vertically-oriented spaced apart members.

14. The system of claim 11 wherein the planar barrier forms a wall about an area.

15. The system of claim 9 wherein the tube is manufactured from a flexible material.

16. The system of claim 9 wherein the tube is manufactured from a semi-rigid material.

17. The system of claim 9 wherein the tube is manufactured from a rigid material.

18. The system of claim 9 wherein the tube is a flexible metal conduit.

19. The system of claim 9 wherein the tube and fiber optic cable function together as a microphone.

20. The system of claim 18 wherein the tube is a BX-type of flexible metal conduit.

* * * * *